US012435577B2

(12) United States Patent
Zhang et al.

(10) Patent No.: US 12,435,577 B2
(45) Date of Patent: Oct. 7, 2025

(54) BIT INSERT FOR A DRILL BIT

(71) Applicant: Schlumberger Technology Corporation, Sugar Land, TX (US)

(72) Inventors: Youhe Zhang, Spring, TX (US); Huimin Song, Spring, TX (US); Yuelin Shen, Spring, TX (US); Xiaoge Gan, Houston, TX (US); Yuri Burhan, Spring, TX (US); Sudarsanam Chellappa, Houston, TX (US); Scott D. McDonough, The Woodlands, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/356,513

(22) Filed: Jul. 21, 2023

(65) Prior Publication Data

US 2024/0026740 A1 Jan. 25, 2024

Related U.S. Application Data

(60) Provisional application No. 63/369,153, filed on Jul. 22, 2022.

(51) Int. Cl.
*E21B 10/62* (2006.01)
*E21B 10/46* (2006.01)

(52) U.S. Cl.
CPC ..... *E21B 10/62* (2013.01); *E21B 10/46* (2013.01)

(58) Field of Classification Search
CPC ..... E21B 10/46; E21B 10/62
See application file for complete search history.

(56) References Cited

U.S. PATENT DOCUMENTS 4,423,646 A * 1/1984 Bernhardt ..... E21B 10/56 29/527.3
4,574,895 A * 3/1986 Dolezal ..... E21B 10/60 175/429
5,568,838 A 10/1996 Struthers et al.
5,924,501 A * 7/1999 Tibbitts ..... E21B 10/5673 175/429
6,131,675 A 10/2000 Anderson
6,523,624 B1 2/2003 Cousins et al.
6,581,702 B2 * 6/2003 Dickey ..... E21B 10/18 175/339

(Continued)

FOREIGN PATENT DOCUMENTS

CN 207406277 U 5/2018
WO 2010011500 A1 1/2010

OTHER PUBLICATIONS

International Search Report and Written Opinion issued in International Patent application PCT/US2023/028372 on Nov. 9, 2023, 10 pages.

*Primary Examiner* — Tara Schimpf
*Assistant Examiner* — Ursula Lee Norris
(74) *Attorney, Agent, or Firm* — Jeffrey D. Frantz

(57) ABSTRACT

A drill bit includes a bit insert. A bit body of the bit includes an insert cavity. The bit insert is inserted into the insert cavity. The bit insert is secured to the insert cavity, such as by braze or with a connection mechanism. The bit insert may be replaceable, thereby allowing a drilling operator to adjust the configuration of the bit based on which bit insert is used.

19 Claims, 11 Drawing Sheets

(56) References Cited

U.S. PATENT DOCUMENTS

| | | | | |
|---|---|---|---|---|
| 6,585,063 | B2 * | 7/2003 | Larsen | E21B 10/61 175/57 |
| 7,571,780 | B2 | 8/2009 | Hall et al. | |
| 8,281,882 | B2 | 10/2012 | Hall et al. | |
| 8,839,886 | B2 | 9/2014 | Jones et al. | |
| 10,301,881 | B2 | 5/2019 | Mada et al. | |
| 10,557,311 | B2 | 2/2020 | Anderle et al. | |
| 10,597,946 | B2 | 3/2020 | Azar | |
| 11,428,050 | B2 * | 8/2022 | Rothe | E21B 10/14 |
| 11,988,046 | B1 * | 5/2024 | Borissov | E21B 4/02 |
| 2011/0240366 | A1 | 10/2011 | Hall et al. | |
| 2019/0383103 | A1 * | 12/2019 | Zhang | F16L 15/008 |
| 2022/0290501 | A1 * | 9/2022 | Drenth | E21B 10/02 |

* cited by examiner

BIT INSERT FOR A DRILL BIT

CROSS-REFERENCE TO RELATED APPLICATIONS

This application claims priority to and the benefit of U.S. Provisional Application No. 63/369,153, filed on Jul. 22, 2022, the entirety of which is incorporated herein by reference.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

Wellbores are drilled using a variety of downhole drilling equipment. The downhole drilling equipment may include a bit. A bit includes cutting elements which may be arranged based on anticipated drilling conditions, such as formation, rock type, and so forth.

SUMMARY

In some embodiments, a drill bit includes a body having a plurality of blades, a bore, and an insert cavity. Each blade of the plurality of blades includes a plurality of blade cutting elements. The bore is hydraulically connected to the insert cavity. A bit insert is inserted into and fixed to the insert cavity. An insert cutting element is connected to the bit insert in a cone region of the body.

In some embodiments, a kit for a bit includes a body with a plurality of blades. The body defines an insert cavity. Each blade of the plurality of blades includes a plurality of blade cutting elements. The body includes a bore connected to the insert cavity. The kit includes plurality of bit inserts. Each bit insert of the plurality of bit inserts is configured to be inserted into and fixed to the insert cavity. Each bit insert includes an insert cutting element connected to the bit insert.

In some embodiments, a method for manufacturing a bit includes preparing a bit body. The bit body defines an insert cavity hydraulically connected to a bore of the bit body. The insert cavity is located in a cone region of the bit body. The insert cavity has a cavity profile. The method includes preparing a bit insert. The bit insert has an insert profile that is complementary to the cavity profile. The bit insert includes an insert cutting element. The method includes inserting the bit insert into the insert cavity and securing the bit insert to the insert cavity.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 is a top-down view of a drill bit, according to at least one embodiment of the present disclosure;

FIG. 3-2 is a cross sectional view of the drill bit of FIG. 3-1;

FIG. 4-1 through FIG. 4-3 are representations of bit inserts, according to at least one embodiment of the present disclosure;

FIG. 5-1 and FIG. 5-2 are representations of bit inserts, according to at least one embodiment of the present disclosure;

FIG. 8-1 and FIG. 8-2 are representations of bit inserts, according to at least one embodiment of the present disclosure;

DETAILED DESCRIPTION

This disclosure generally relates to devices, systems, and methods for a modular bit having a removable bit insert. A bit may be formed having a cavity. A bit insert may have a complementary or similar shape to the cavity. The bit insert may be inserted into the cavity and secured to the bit, such as by braze or with a mechanical fastener. The bit insert may help to prevent the formation of cracks on the bit body by absorbing drilling stresses. Drilling stresses may be absorbed by the bit insert, and any cracking or damage that the drilling stresses may cause may occur at the bit insert, rather than the bit body. The bit insert may be replaced, thereby extending the life of the bit.

In accordance with at least one embodiment of the present disclosure, multiple bit inserts may be configured to be inserted into and connected to the cavity in the bit body. Different bit inserts may have different configurations of cutting elements. By changing the bit insert on a bit, the configuration of the cutting elements at the bit may change. This may allow different bit designs. In some embodiments, the bit insert may include one or more hydraulic paths to allow drilling fluid to cool and clean the center portion of the bit.

The bit insert may be connected to the cavity in the bit body with any mechanism. For example, the bit insert may be brazed to the cavity. In some embodiments, a connection mechanism may be inserted through the downstream portion of the bit. In some embodiments, the bit insert may be connected to the bit body with an interlocking connection, such as a threaded connection. This may help to increase the connection of the bit insert to the bit body.

Figure 1:
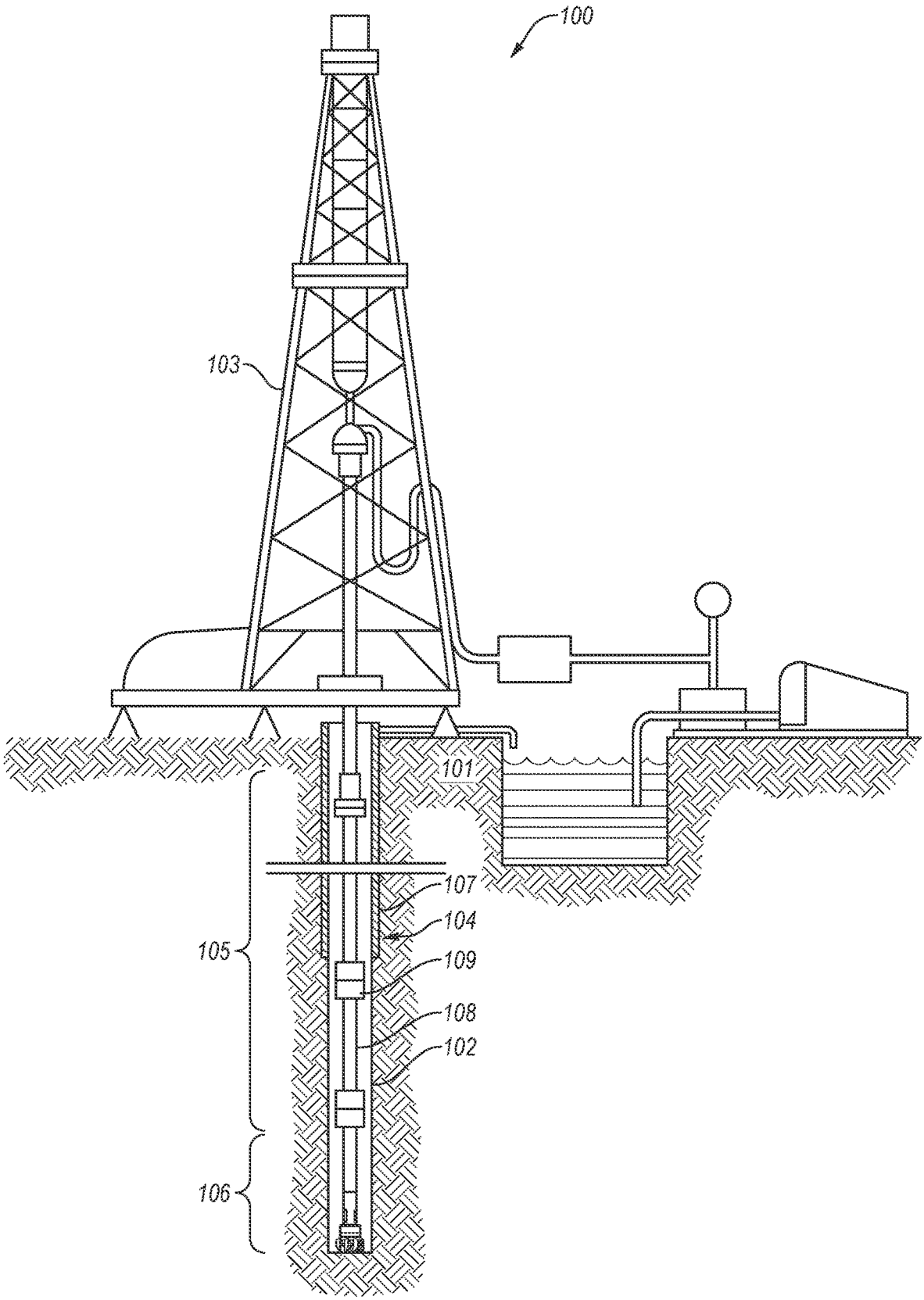
FIG. 1 is a representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

The bit 110 includes a plurality of cutting elements. The cutting elements may be arranged around one or more blades in a pattern to cut, erode, or otherwise degrade the formation and advance the wellbore. In some embodiments, one or more cutting elements may be connected to a bit insert. The bit insert may be inserted into a cavity in the bit body of the bit 110. Forces applied to the bit that may crack or otherwise damage the bit 110 may be applied to the bit insert. Cracks or other damage to the bit may render the bit 110 inoperable, resulting in replacement of the entire bit body. The bit insert may be easily replaced. This may increase the operational lifetime of the bit 110.

Figure 2:
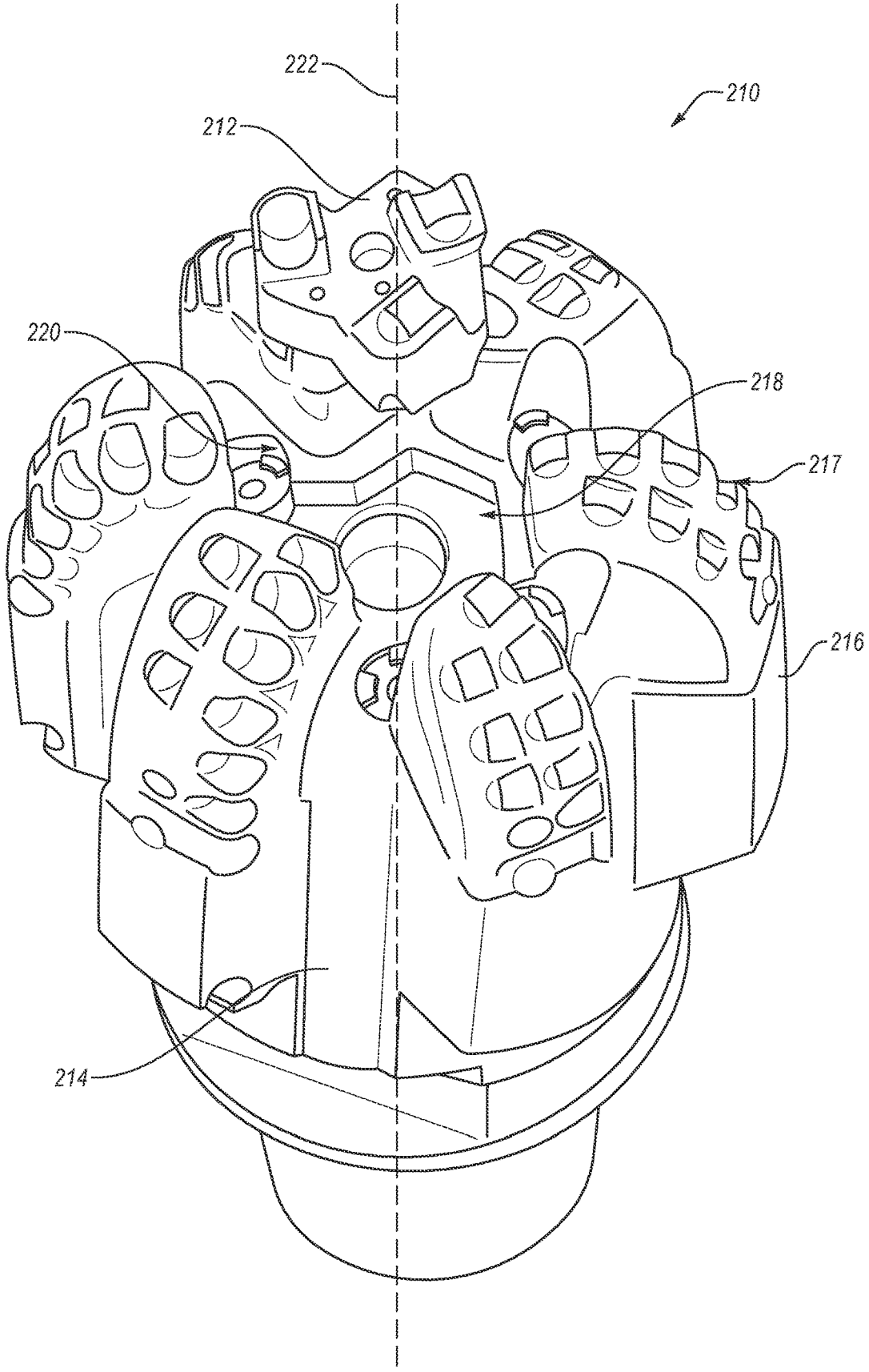
FIG. 2 is a perspective view of a drill bit, according to at least one embodiment of the present disclosure.

FIG. 2 is an exploded perspective view of a bit 210 having a bit insert 212, according to at least one embodiment of the present disclosure. The bit 210 has a bit body 214. The bit body 214 may be formed of one or more matrix materials, such as a carbide infiltrated with a binder. In some embodiments, the bit body 214 is machined from one or more blanks, such as a steel blank. A plurality of blades 216 may be connected to the bit body 214. Blade cutting elements may be connected to pockets 217 of the blades 216. The blade cutting elements be configured to engage the formation, thereby advancing the wellbore. One or more insert cutting elements may be connected to the bit insert 212. The insert cutting elements may be arranged to erode or otherwise remove the formation. Cutting elements of the bit 210 arranged in the bit insert 212 and the blades 216 may be planar cutting elements, nonplanar (e.g., conical) cutting elements, or any combination thereof.

The bit body 214 may form an insert cavity 218. The insert cavity 218 may be formed on an outer surface (e.g., downhole face) of the bit body 214. The bit insert 212 may be inserted into the insert cavity 218. The bit insert 212 may be secured or attached to the bit body 214 at or in the insert cavity 218.

The insert cavity 218 has a cavity profile, which may be the shape and/or size of the inner surface of the insert cavity 218. The bit insert 212 may have an insert profile, which may be the shape and/or size of the outer surface of the bit insert 212. In accordance with at least one embodiment of the present disclosure, the insert profile may be complementary to the cavity profile. In this manner, the bit insert 212 may be inserted into the insert cavity 218 with close fit. In some embodiments, the bit insert 212 may have an interference fit with the insert cavity 218. In some embodiments, the bit insert 212 may have a clearance fit with a tolerance to facilitate brazing in the insert cavity 218.

During drilling activities, the bit body 214 may experience forces, including impact forces, weight on bit, torque, any other drilling force, and combinations thereof. Conventionally, the forces may weaken and/or cause cracks in the material of the bit body 214. Cracks in the bit body 214 may result in the bit body 214 being unfit for further drilling activities. This may cause the drilling operator to replace the entire bit, thereby increasing drilling costs.

In accordance with at least one embodiment of the present disclosure, the bit insert 212 may be placed in one or more high-force or high-impact locations of the bit body 214. For example, in some embodiments, cutting elements in the cone 220 region of a bit 210, which is near the axis of rotation 222 of the bit 210, may experience high drilling forces. The drilling forces on the cone cutting elements may cause the cutting elements and/or the bit body 214 to crack in the cone 220. In some embodiments, the bit insert 212 may have a greater resilience and/or toughness than the bit body 214. In some embodiments, the bit insert 212 may have less resilience and/or toughness than the bit body 214. For example, the bit insert 212 may be easily or readily replaceable. The bit insert 212 may be formed from a less resilient material and replaced when the bit insert 212 wears or when a new geometry of the bit insert 212 is desired (e.g., for a different application). By placing the bit insert 212 where cracking of the bit body 214 is likely to occur, such as in the cone 220, the drilling forces may cause the bit insert 212 to crack.

In accordance with at least one embodiment of the present disclosure, the bit insert 212 may be replaceable. When drilling forces crack or otherwise damage the bit insert 212, the bit insert 212 may be removed from the bit body 214. A new bit insert 212 may then be installed in the insert cavity 218. The bit 210 may then be returned downhole and used for additional drilling operations. In this manner, drilling forces may only damage the bit insert 212, leaving the bit body 214 undamaged. This may extend the operational lifetime of the bit 210, thereby reducing the cost of drilling operations.

As will be discussed in further detail herein, the bit insert 212 may have different configurations. For example, the bit insert 212 may have different shapes, cutting element arrangements, insert profiles, hydraulics paths, and so forth. This may allow for variations in bit design at the location of the bit insert 212. For example, in FIG. 2, the bit insert 212 is located at the cone 220, and changing the design of the bit insert 212 may cause a change in the design of the bit 210 at the cone 220. This may allow the drilling operator to adjust the bit 210 based on drilling conditions, which may improve the drilling rate of penetration and/or reduce drilling costs.

As discussed herein, the insert profile of the bit insert 212 may be complementary to the cavity profile of the insert cavity 218. In some embodiments, the insert profile and the cavity profile may be non-circular. A non-circular insert profile and cavity profile may help to prevent rotation of the bit insert 212 in the insert cavity 218. This may help to secure the bit insert 212 in the bit body 214, thereby preventing undesired or unintentional rotation or removal of the bit insert 212 during operation.

Figures 1, 3:
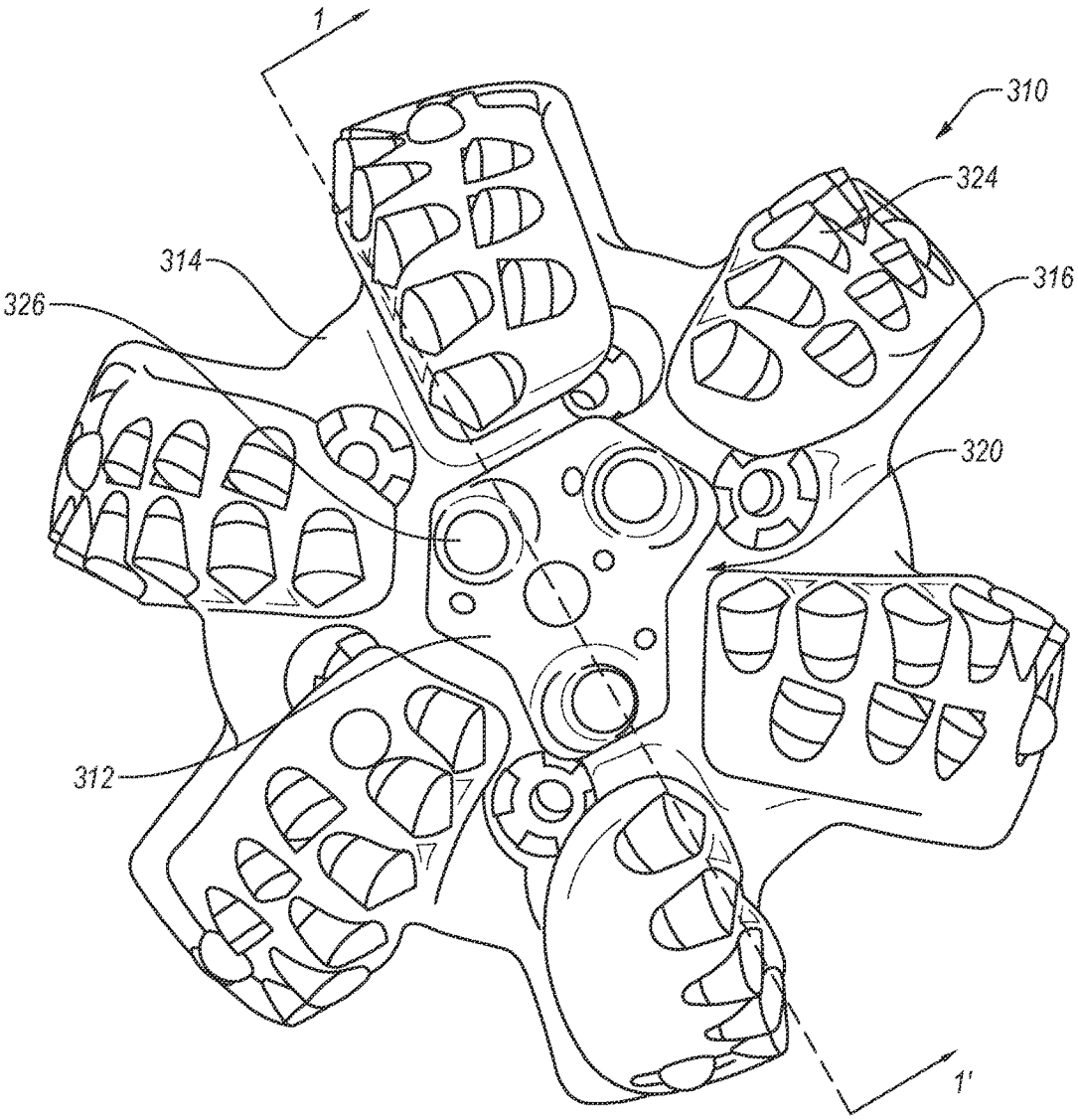
Figures 2, 3:
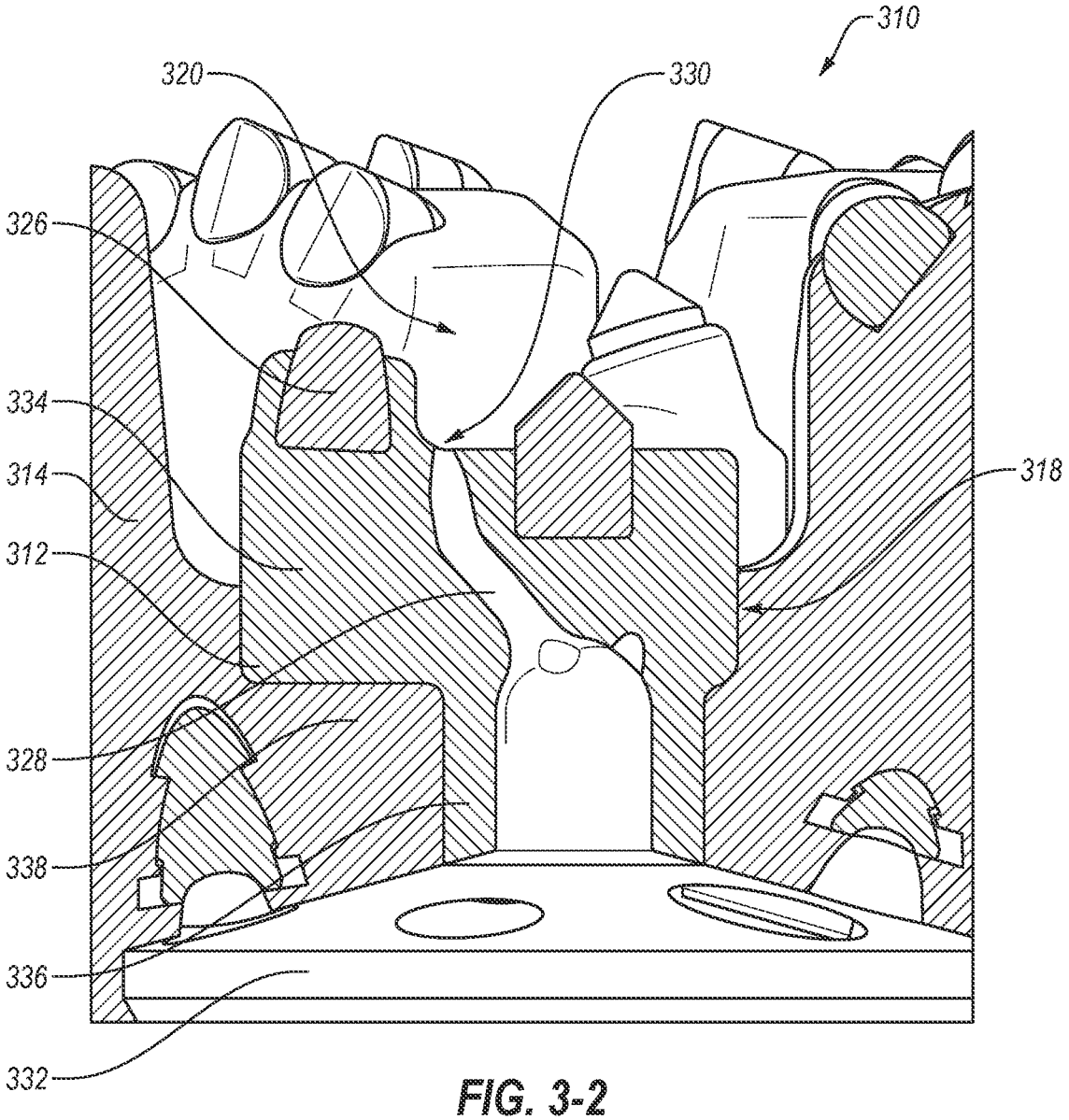

FIG. 3-1 is a top-down view of a bit 310 having a bit insert 312 located in a cone 320 region of the bit 310, according to at least one embodiment of the present disclosure. The bit 310 includes a plurality of blades 316 having a plurality of blade cutting elements 324. The blades 316 are extend from a bit body 314. The bit insert 312 includes one or more insert cutting elements 326. For example, the bit insert 312 shown includes four insert cutting elements 326, including three angled insert cutting elements 326 and a central insert cutting element 326 located at the axis of rotation of the bit 310. However, it should be understood that the bit insert 312 may include any quantity of insert cutting elements 326, including 1, 2, 3, 4, 5, 6, 7, 8, 9, 10, or more insert cutting elements 326.

In some embodiments, the insert cutting elements 326 may have any shape, including conical, domed, wedge-shaped, axe-shaped, any other shape of insert cutting elements 326, and combinations thereof. In some embodiments, each of the insert cutting elements 326 may have the same shape. In some embodiments, different insert cutting elements 326 may have different shapes. As discussed herein, the bit insert 312 may be configurable with different quantities, placements, and/or types of insert cutting elements 326. In this manner, the cutting structure of the bit insert 312 may be customized according to particular drilling conditions.

FIG. 3-2 is a cross-sectional view of the bit 310 along the line 1-1'. As shown, the bit insert 312 is located in an insert cavity 318 in the bit body 314. The bit insert 312 may be secured to the bit body 314 in any manner. For example, the bit insert 312 may be secured to the bit body 314 using braze a braze or a weld. In some examples, the bit insert 312 may be secured to the bit body 314 using a mechanical fastener and/or press fitting. In some embodiments, the bit insert 312 may be secured to the bit body 314 using an interlocking connection, such as threads or another interlocking connection.

To facilitate a secure connection, such as a secure brazed connection, one or more portions of the insert profile of the bit insert 312 may be complementary to one or more respective portions of an insert profile of the insert cavity 318. By having complementary profiles that fit within a brazing tolerance, a secure brazed connection may be formed between the bit insert 312 and the bit body 314.

In the embodiment shown, the bit insert 312 includes one or more hydraulic paths 328. The hydraulic paths 328 may connect to one or more openings 330. The hydraulic paths 328 may direct drilling fluid from a bore 332 in the bit 310. As the drilling fluid exits the hydraulic paths 328 through the openings 330, the drilling fluid may provide cleaning, cooling, and cuttings removal for the volume around the bit insert 312. The bit insert 312 may include one or more hydraulic paths 328, including 1, 2, 3, 4, 5, 6, 7, 8, 9, 10, or more hydraulic paths 328. The quantity of hydraulic paths 328 may be based on the size of the bit insert 312. For example, the quantity of hydraulic paths 328 may be determined based on how many hydraulic paths 328 may fit in the bit insert 312 without compromising the structural integrity of the bit insert 312. In some examples, the quantity of hydraulic paths 328 may be based on the quantity of insert cutting elements 326. For example, a bit insert 312 having more insert cutting elements 326 may have more hydraulic paths 328, and a bit insert 312 having fewer insert cutting elements 326 may have fewer hydraulic paths 328. In some embodiments, the hydraulic path opening size may vary based on the location, size, and/or shape of the cutting element. In some embodiments, the hydraulic path opening size may be in a range having an upper value, a lower value, or upper and lower values including any of 0.0625 in. (1.6 mm), 0.125 in. (3.2 mm), 0.25 in. (6.4 mm), 0.375 in. (9.5 mm), 0.5 in. (12.7 mm), 0.625 in. (15.9 mm), 0.75 in. (19.1 mm), or any value therebetween. For example, the hydraulic path opening size may be greater than 0.0625 in (1.6 mm). In another example, the hydraulic path opening size may be less than 0.75 in. (19.1 mm). In yet other examples, the hydraulic path opening size may be any value in a range between 0.0625 in. (1.6 mm) and 0.75 in. (19.1 mm). In some embodiments, the hydraulic path opening shape may include any shape, such as circular, ovoid, elongate ovoid, rectangular, triangular, any other shape, and combinations thereof.

Conventionally, nozzles and other hydraulic paths in the cone 320 may be difficult to accurately direct or otherwise implement. The bit inserts 312 of the present disclosure may allow for specific geometries of the hydraulic paths 328, thereby improving the cleaning capacity of the bit 310 at the cone 320. In some embodiments, the openings 330 may be formed from the material of the bit insert 312. In some embodiments, the openings 330 may include a nozzle or other director of the drilling fluid.

The bit insert 312 may be formed in any manner. For example, the bit insert 312 may be cast and machined to the final dimensions. In some embodiments, the bit insert 312 may be machined from a blank, such as a steel blank. In some examples, the bit insert 312 may include a hard material powder that is infiltrated with an infiltrant. In some examples, the bit insert 312 may be formed from an additive manufacturing process. Additive manufacturing may allow for fast and relatively low-cost construction of the bit insert 312. In some embodiments, additive manufacturing of the bit insert 312 may allow for the construction of complex geometries of the bit insert 312, including curves and/or bends in the hydraulic paths 328 to direct drilling fluid in a desired direction.

The bit insert 312 includes an insert body 334 and an insert shaft 336. The insert body 334 may rest on or be supported by a seat 338 on the bit body 314. The insert shaft 336 may extend to the bore 332. This may allow drilling fluid from the bore 332 to enter the hydraulic paths 328 through the insert shaft 336. The seat 338 may support the bit insert 312, including supporting uphole drilling forces caused by weight on bit, or other drilling forces.

Figures 2, 4:
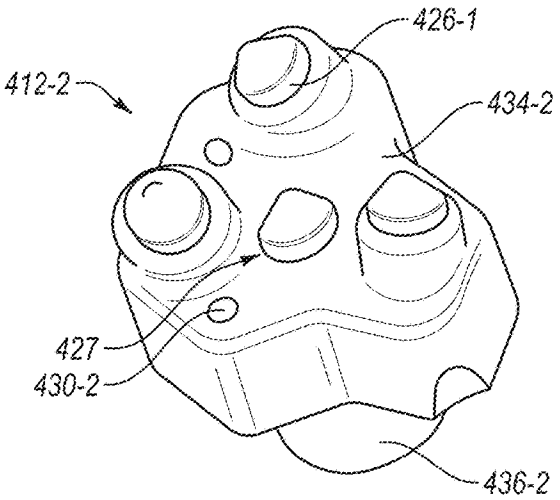
Figures 1, 4:
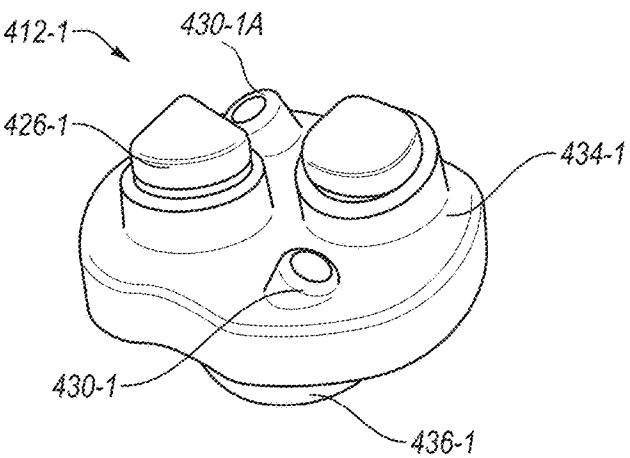
Figures 3, 4:
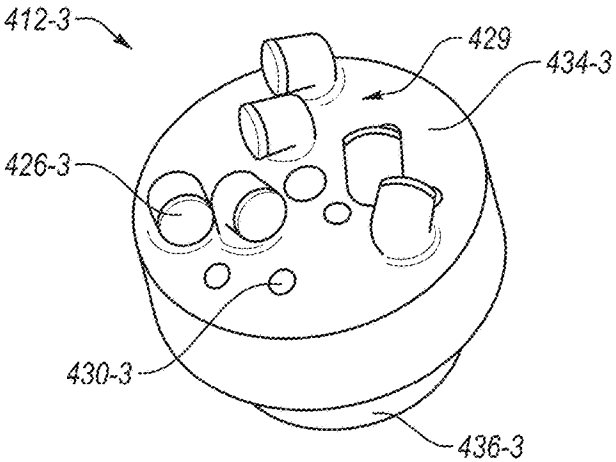

FIG. 4-1 through FIG. 4-3 are representations of configurations of a bit insert (collectively 412), according to at least one embodiment of the present disclosure. As discussed herein, the bit insert 412 may have different configurations, such as different shapes of the insert body (collectively 434), different shapes of the insert shaft 336, and so forth. In some embodiments, the bit insert 412 may have different configurations of insert cutting elements (collectively 426), including different quantities, different arrangements, different shapes, rake angle, orientation, placement, and any other different configuration of drilling cutting elements. In some embodiments, the bit insert 412 may have different configurations of openings (collectively 430) that may receive drilling fluid from the hydraulic paths in the bit insert 412, including different quantities, orientations, diameter openings, pressure, any other factor, and combinations thereof. While FIG. 4-1 through FIG. 4-3 show specific examples of bit inserts 412, it should be understood that these are illustrative examples, and that any configuration of bit insert 412 may be used in accordance with this disclosure.

In the example shown in FIG. 4-1, a first bit insert 412-1 has two first insert cutting elements 426-1. As shown, the first insert cutting elements 426-1 may be conical. The first insert cutting elements 426-1 may be located offset from a center of the first bit insert 412-1, and the first bit insert 412-1 may not have a central cutting element. The first bit insert 412-1 may have two first openings 430-1, 430-1A. The first openings 430-1, 430-1A may direct drilling fluid toward the general cutting area of the first insert cutting elements 426-1. One or more of the openings 430 may be arranged in leading positions relative to the insert cutting elements 426.

The first bit insert 412-1 has a first insert body 434-1 connected to a first insert shaft 436-1. In the embodiment shown, the first insert body 434-1 has a non-circular shape. This may be inserted into an insert cavity having a complementary shape. The non-circular shape of the first insert body 434-1 may help to prevent rotation or other inadvertent movement of the first bit insert 412-1 in the bit body.

In the example shown in FIG. 4-2, a second bit insert 412-2 has four second insert cutting elements 426-2. The second insert cutting elements 426-2 may include a central second insert cutting element 427 located in a center of a second insert body 434-2. Three second insert cutting elements 426-2 may surround the central second insert cutting element 426-2. The second insert cutting elements 426-2 are radially spaced from the central cutting element 427. In some embodiments, the radial spacing of the second insert cutting elements 426-2 varies, such as in a forward spiral or reverse spiral configuration. The radial spacing of the second insert cutting elements 426-2 may be the same.

The second bit insert 412-2 has three second openings 430-2. The second openings 430-2 shown are located between the three outer second insert cutting elements 426-2 and may be oriented to clean the cuttings formed by these outer second insert cutting elements 426-2.

The second insert body 434-2 is connected to a second insert shaft 436-2. In the embodiment shown, the second insert body 434-2 has a non-circular shape. This may be inserted into an insert cavity having a complementary shape. The non-circular shape of the second insert body 434-2 may help to prevent rotation or other inadvertent movement of the second bit insert 412-2 in the bit body.

In the example shown in FIG. 4-3, a third bit insert 412-3 has seven third insert cutting elements 426-3. Three sets 429 of two third insert cutting elements 426-3 surround a central third insert cutting element 426-3. The third bit insert 412-3 has a plurality of third openings 430-3. The third openings 430-3 may direct drilling fluid to clear the cutting generated from the third insert cutting elements. In the embodiment shown, the third bit insert 412-3 has a cylindrical third insert body 434-3 connected to a third insert shaft 436-3. A cylindrical third insert body 434-3 may be easily interchangeable between different bits having different bit designs, thereby increasing the modularity and replaceability of the bits based on the third bit insert 412-3.

In some embodiments, one or more of the insert cutting elements 426 may be planar cutting elements, nonplanar (e.g., conical) cutting elements, or any combination thereof. In some embodiments, a shape of the insert body 434 may remain the same among different bit inserts. This may allow the insert body 434 to be interchangeable within different bits. In some embodiments, the cutting element type (e.g., planar or nonplanar) may change between different insert bodies 434. For example, an insert cavity (e.g., insert cavity 218) may have a shape that fits an insert body 434 shape. Based on drilling conditions and other factors, a drilling operator may prepare multiple different insert bodies 434 that have the same insert body 434 shape but have different types and/or patterns of insert cutting elements 426. This may help to increase the customizability of a particular drill bit.

Figures 2, 5:
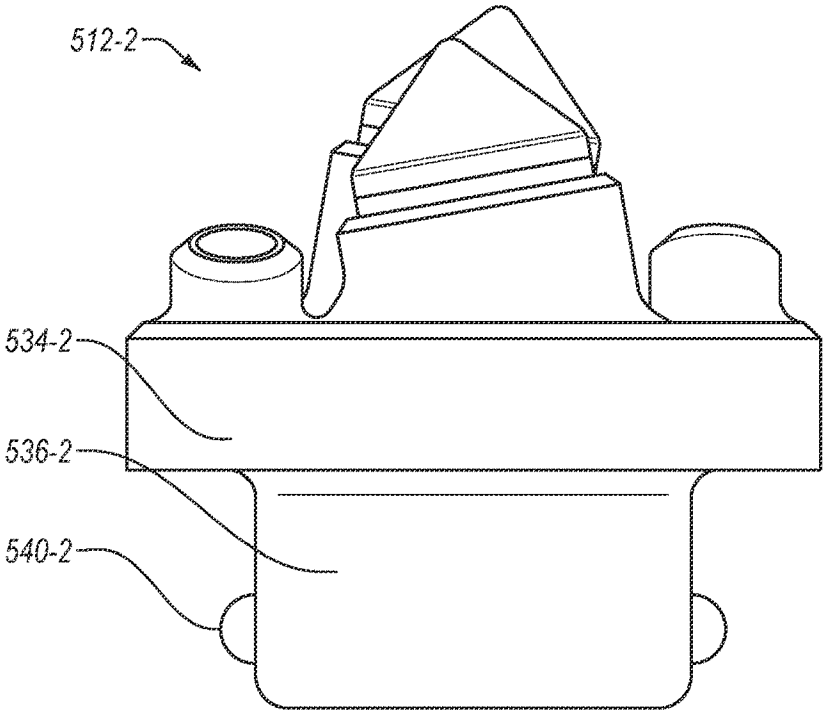
Figures 1, 5:
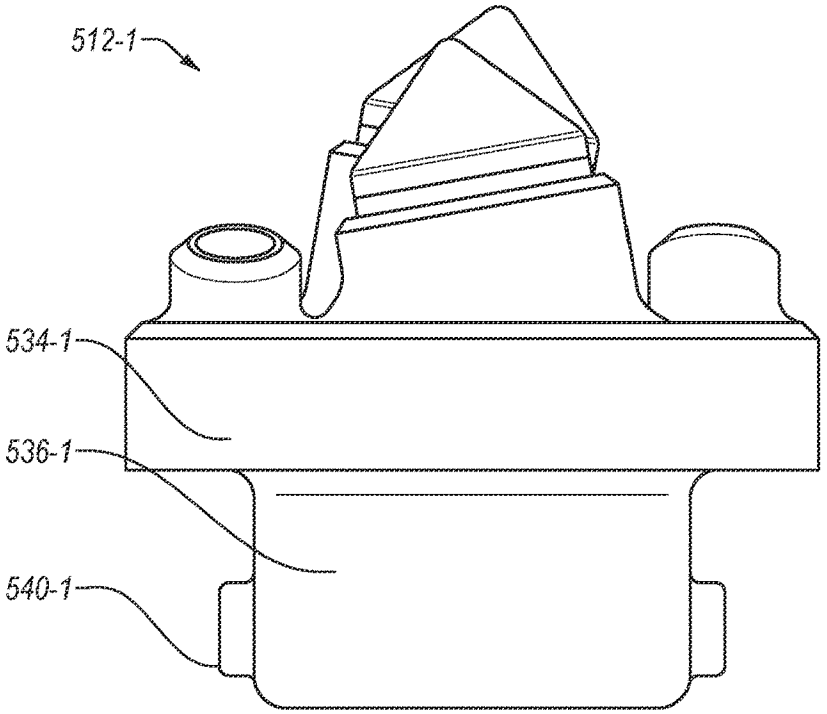

FIG. 5-1 is a side view of a first bit insert 512-1 having first interlocking features 540-1 of a first insert shaft 536-1, according to at least one embodiment of the present disclosure. The first bit insert 512-1 has a first insert body 534-1 connected to a first insert shaft 536-1. The first insert shaft 536-1 includes first interlocking features 540-1. The first interlocking features 540-1 extend radially from the first insert shaft 536-1.

The first interlocking features 540-1 may be configured to interact with similar cavities or detents in the insert cavity of the bit. For example, during installation of the first bit insert 512-1, the first insert shaft 536-1 may be inserted into the insert cavity. The first bit insert 512-1 may be rotated, thereby moving the first interlocking features 540-1 into an interlocking groove in the insert cavity. The first bit insert 512-1 may be secured to the bit body with the first interlocking features 540-1 inserted into the interlocking groove. This may help to prevent the first bit insert 512-1 from moving longitudinally outward from the insert cavity.

In the embodiment shown in FIG. 5-1, the first interlocking features 540-1 have a rectangular shape. But the interlocking features may have any shape. For example, FIG. shows a second bit insert 512-2 having a second insert body 534-2 connected to a second insert shaft 536-2. The second bit insert 512-2 includes second interlocking features 540-2. In the embodiment shown, the second interlocking features 540-2 may be rounded, or have a hemispherical or domed shape. Domed second interlocking features 540-2 may help to increase the ease of insertion into the interlocking groove of the insert cavity.

While the interlocking features 540 shown in FIG. 5-1 and FIG. 5-2 are protrusions from the insert shaft 536, it should be understood that the interlocking features 540 may include cavities or depressions in the insert shaft 536. The insert cavity may include one or more protrusions that extend into the insert cavity. As the insert shaft 536 is inserted into the insert cavity, the protrusions may extend into the cavities or depressions that form the interlocking features 540 on the insert shaft 536. In some embodiments, the cavities or depressions may extend around a portion of the insert shaft 536, thereby helping to prevent longitudinal removal of the bit insert from the cavity.

Figure 6:
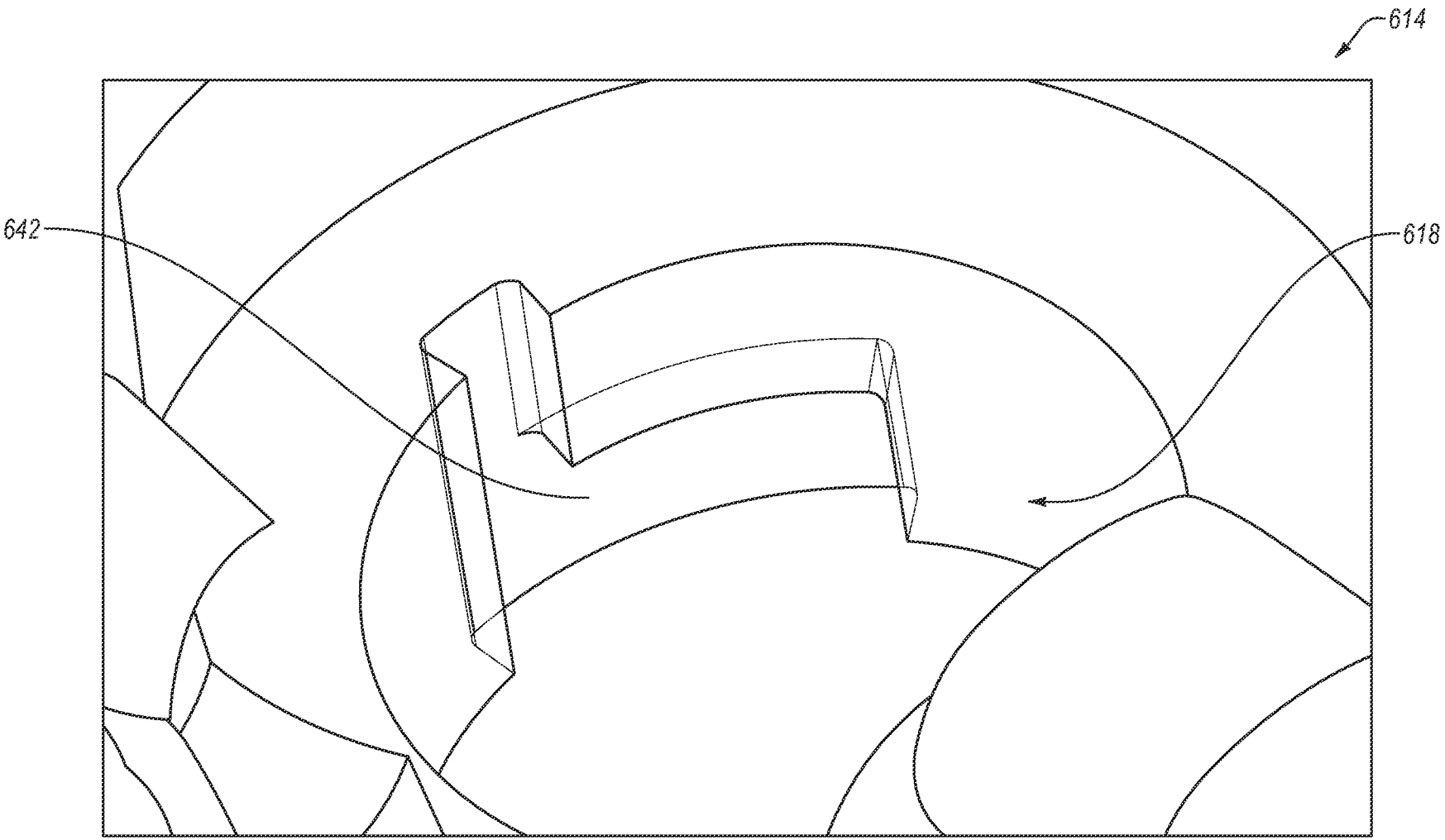
FIG. 6 is a representation of a bit body having an insert cavity, according to at least one embodiment of the present disclosure.

FIG. 6 is a representation of an insert cavity 618 in a bit body 614, according to at least one embodiment of the present disclosure. An interlocking groove 642 is located on an inner surface of the insert cavity 618. During installation, the bit insert (such as the first bit insert 512-1 of FIG. 5-1 or the second bit insert 512-2 of FIG. 5-2) may be inserted into the insert cavity 618. The interlocking features (such as the first interlocking features 540-1 of FIG. 5-1 or the second interlocking features 540-2 of FIG. 5-2) may be aligned with the interlocking groove 642. The bit insert may be rotated as it is inserted into the insert cavity 618. This may cause the interlocking features to be moved further into the interlocking groove 642, thereby preventing axial removal of the bit insert without breaking of the material of the bit body 614.

Figure 7:
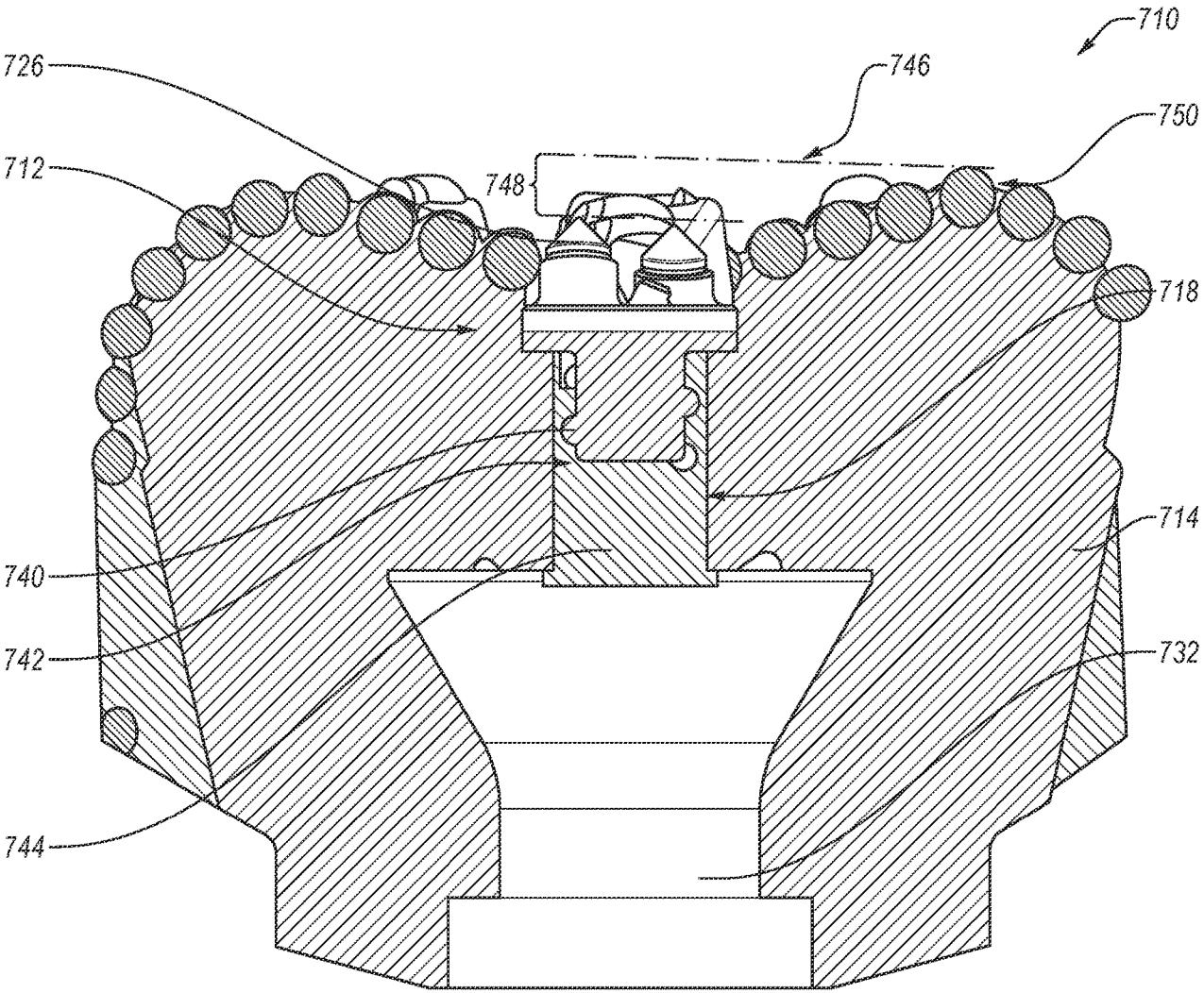
FIG. 7 is a cross-sectional view of a bit, according to at least one embodiment of the present disclosure.

FIG. 7 is a cross-sectional view of a bit 710 having a bit body 714, according to at least one embodiment of the present disclosure. The bit body 714 includes a bore 732 into which drilling fluid may be pumped. An insert cavity 718 may be formed in the bit body 714. The insert cavity 718 may extend through the bit body 714 from the bore 732 to the downhole edge of the bit 710.

A bit insert 712 may be inserted into the insert cavity 718. The bit insert 712 may have insert cutting elements 726 that may be configured to engage the formation. The 712 may be inserted into the insert cavity 718 from a downhole end 746 of the bit 710. The insert cutting elements 726 may have an exposure 748, which may be a distance from the tip of the insert cutting elements 726 to blade cutting elements at a downhole-most end 750 of the bit 710. In the embodiment shown, the bit insert 712 has a negative exposure, meaning that the tip of the insert cutting elements 726 may be located below the downhole-most end 750.

An attachment mechanism 744 may help to secure the bit insert 712 to the bit body 714. The attachment mechanism 744 may be inserted into the insert cavity 718 from the bore 732. The attachment mechanism 744 may include one or more interlocking grooves 742. The bit insert 712 may include one or more interlocking features 740. The interlocking features 740 may engage with the interlocking grooves 742 to connect the bit insert 712 to the attachment mechanism 744.

In some embodiments, the attachment mechanism 744 may be brazed or otherwise connected to the insert cavity 718. The interlocking features 740 and the interlocking grooves 742 may engage to secure the bit insert 712 to the bit body 714. In some embodiments, the interlocking grooves 742 may include threads, and the interlocking features 740 may be screwed or threaded into the interlocking grooves 742. This may assist axial retention of the bit insert 712 within the insert cavity 718.

In some embodiments, twisting the interlocking features 740 into the interlocking grooves 742 may place the attachment mechanism 744 and the bit insert 712 in tension. Placing the attachment mechanism 744 and the bit insert 712 in tension may help to further secure the bit insert 712 to the bit body 714 without placing the material of the bit body 714 in tension. This may help to improve the strength of the connection of the bit insert 712 to the bit body 714, thereby reducing the chance of cracking or breaking of the bit body 714.

The attachment mechanism 744 may be connected to the bit body 714 in any manner. For example, the attachment mechanism 744 may be brazed to the bit body 714, welded to the bit body 714, threaded into the bit body 714, connected to the bit body 714 with a mechanical attachment, connected to the bit body 714 in any other manner, and combinations thereof.

In some embodiments, the bit insert 712 may only be connected to the attachment mechanism 744. The bit insert 712 may be threaded into the attachment mechanism 744 to secure the bit insert 712 to the bit body 714. In some embodiments, the bit insert 712 may be connected to the attachment mechanism 744 with a secondary mechanism. For example, the bit insert 712 may be brazed, welded, or otherwise connected to the attachment mechanism 744.

In some embodiments, the bit insert 712 may be connected to both the attachment mechanism 744 and the bit body 714. For example, the bit insert 712 may be brazed to both the attachment mechanism 744 and the bit body 714. In some embodiments, the bit insert 712 may be threaded into the attachment mechanism 744 and brazed to the bit body bit body 714. In some embodiments, the attachment mechanism 744 and the bit insert 712 may be simultaneously brazed to the bit body 714. In some embodiments, the attachment mechanism 744 may be brazed to the bit body 714 first, then the bit insert 712 may be brazed to the attachment mechanism 744 and the bit body 714 afterward.

In accordance with at least one embodiment of the present disclosure, different attachment mechanisms 744 may have different features. For example, different attachment mechanisms 744 may have different lengths, which may change the exposure 748 of the bit insert 712. A longer attachment mechanism 744 may result in a higher exposure 748. A shorter attachment mechanism 744 may result in a lower exposure 748.

In some embodiments, the attachment mechanism 744 may include one or more internal openings to allow the drilling fluid from the bore 732 to flow through to clean and/or to cool the cutting elements on the insert 712. In some embodiments, a sealing element may be placed between the bit insert 712 and the bit body. This may help to prevent hydraulic leaks. In some embodiments, the sealing element may include any type of sealing element, such as an O-ring and the like.

Figures 2, 8:
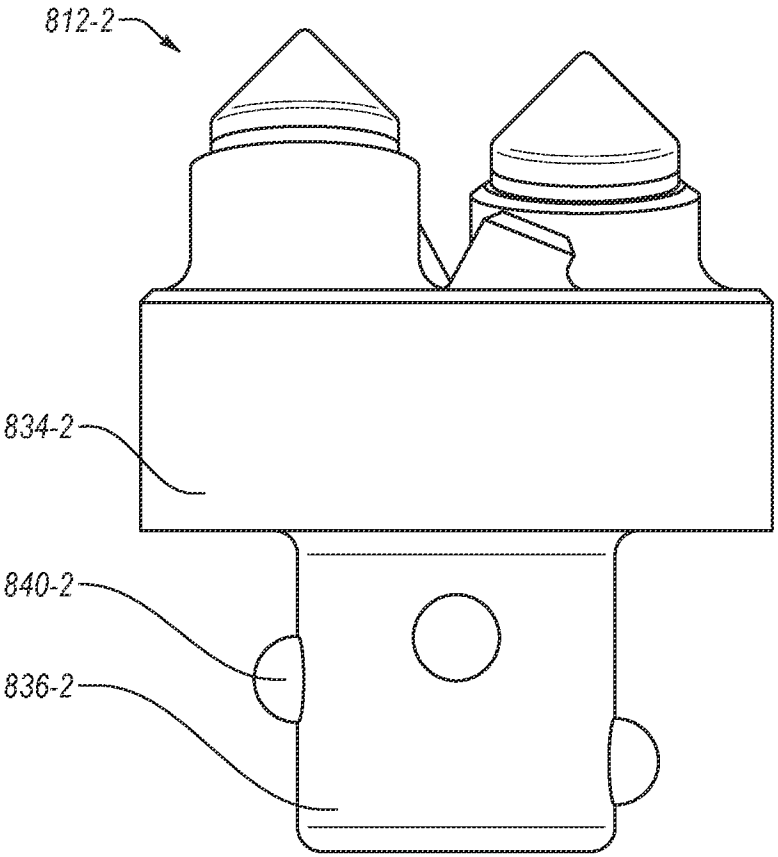
Figures 1, 8:
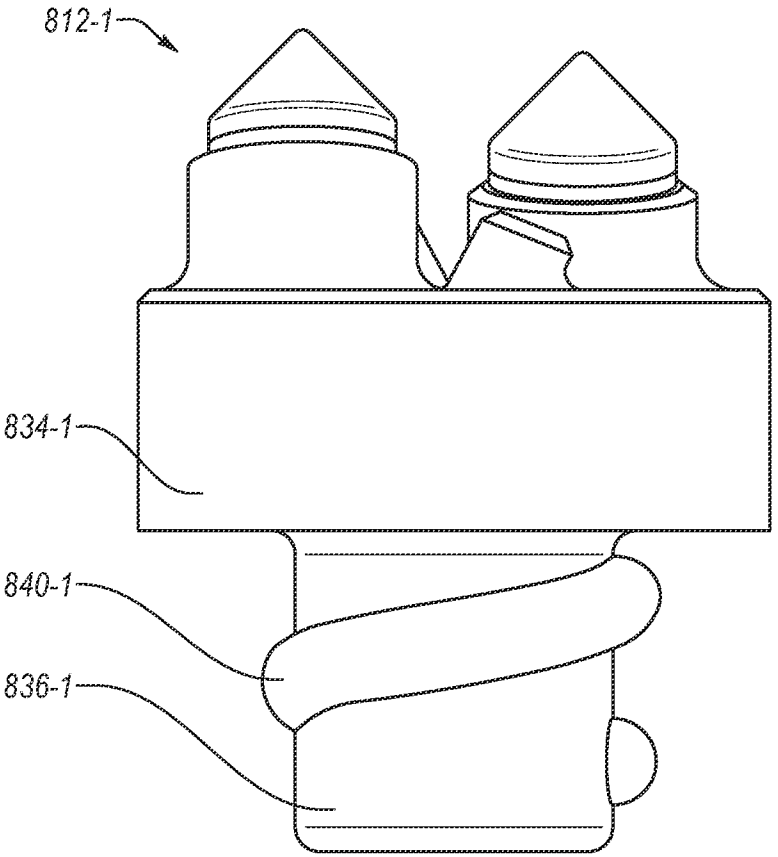

FIG. 8-1 and FIG. 8-2 are representations of bit inserts 812, having interlocking features to engage with an attachment mechanism (e.g., attachment mechanism 744 of FIG. 7), according to at least one embodiment of the present disclosure. In FIG. 8-1, a first bit insert 812-1 has a first insert body 834-1 connected to a first insert shaft 836-1. A first interlocking feature 840-1 is connected to the first insert shaft 836-1. The first interlocking feature 840-1 of FIG. 8-1 may be full threads, or threads that are continuous throughout the length of the thread. The full threads may increase the engagement of the first interlocking feature 840-1 with the attachment mechanism, thereby increasing the strength of the connection of the first bit insert 812-1 to the bit body.

In FIG. 8-2, a second bit insert 812-2 has a second insert body 834-2 connected to a second insert shaft 836-2. A second interlocking feature 840-2 is connected to the second insert shaft 836-2. The second interlocking feature 840-2 shown is a partial thread, including knobs or protrusions spaced radially and longitudinally around the second insert shaft 836-2. The knobs or protrusions of the second interlocking feature 840-2 may be spaced along a thread path without being continuous between two separate protrusions.

In accordance with at least one embodiment of the present disclosure, the protrusions of the second interlocking feature 840-2 may not be continuous to improve the ease of manufacturing. Individual protrusions may be easier to manufacture than a continuous thread around the outer surface of the second insert shaft 836-2. In some embodiments, individual protrusions to use as threads or to thread into an interlocking groove in an attachment mechanism or the bit body may have a lower manufacturing tolerance. This may reduce post-processing of the second bit insert 812-2, thereby reducing manufacturing costs and/or improving ease of installation. In some embodiments, a sealing element, such as an O-ring or other sealing element, may be located between the second bit insert 812-2 and the attachment mechanism.

Figure 9:
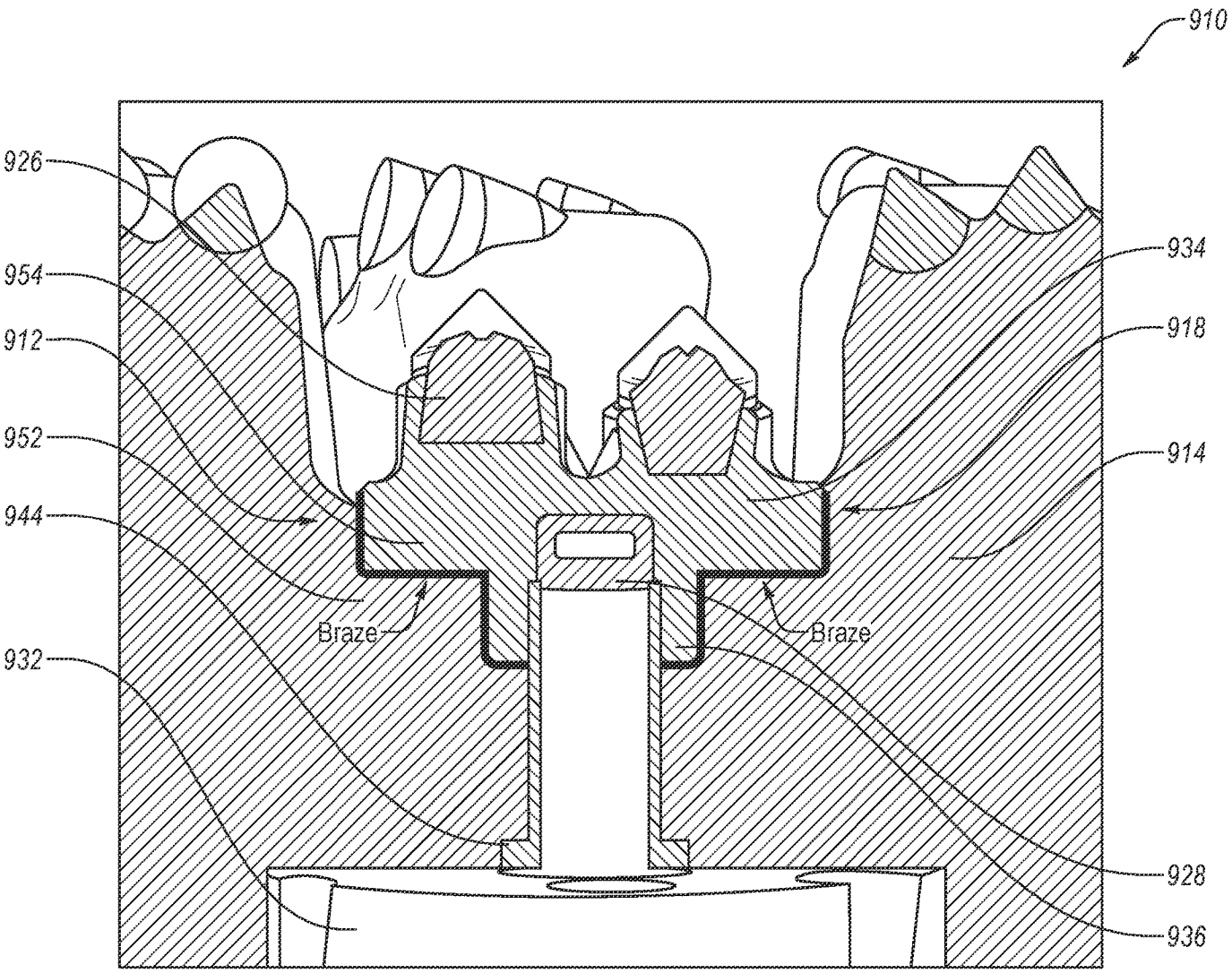
FIG. 9 is a representation of a cross-sectional view of a bit, according to at least one embodiment of the present disclosure.

FIG. 9 is a cross-sectional view of a portion of a bit 910 having an insert 912 inserted into an insert cavity 918, according to at least one embodiment of the present disclosure. In the embodiment shown, the insert cavity 918 has a cavity profile that includes a cavity shoulder 952. The insert 912 has an insert profile that includes an insert shoulder 954. As discussed herein, the cavity profile and the insert profile may be complementary. In this manner, the insert shoulder 954 may engage the cavity shoulder 952, thereby improving the strength of the connection or support of the insert 912 to the bit body 914. In some embodiments, a seal may be located between the bit insert 912 and the cavity shoulder 952.

The insert 912 includes an insert shaft 936 having a primary hydraulic path 928 that may extend into an insert body 934. A connection mechanism 944 may secure or at least partially secure the insert 912 to the bit body 914. In the embodiment shown, the inner surface of insert shaft 936 (e.g., in the primary hydraulic path 928) may be threaded with a threaded connection, including internal threads. The connection mechanism 944 may have an exterior surface that is threaded, and the connection mechanism 944 may thread into the inner threaded connection of the insert shaft 936. By threading the connection mechanism 944 into the insert shaft 936, the connection mechanism 944 may secure the insert 912 to the bit body 914.

In some embodiments, threading the connection mechanism 944 may place the 912 and the 944 into tension, placing the bit body 914 between the insert 912 and the bore 932 into compression. The connection mechanism 944 may be inserted into the insert cavity 918 through the bore 932 and threaded into the insert 912. In some embodiments, the insert 912 may be rotated relative to the connection mechanism 944. In some embodiments, the connection mechanism 944 may be rotated relative to the insert 912. In some embodiments, the insert 912 may include one or more interlocking features that may prevent rotation of the insert 912 within the insert cavity 918. To secure the insert 912 to the bit body 914, the connection mechanism 944 may be threaded into the insert 912 and rotated relative to the bit body 914. In some embodiments, the connection mechanism 944 may be difficult to access during assembly of the bit 910. To facilitate assembly, the connection mechanism 944 may be keyed into the insert cavity 918, and the insert 912 may be rotated to thread the insert 912 and the connection mechanism 944 together.

In accordance with at least one embodiment of the present disclosure, the insert 912 may be brazed to the bit body 914 and secured to the connection mechanism 944. In some embodiments, the insert 912 may be brazed to the bit body 914 while the connection mechanism 944 is secured to the bit body 914 by threading into the insert 912 In some embodiments, the insert 912 may be brazed to the bit body bit body 914 before threading the connection mechanism 944 into the insert 912.

Figure 10:
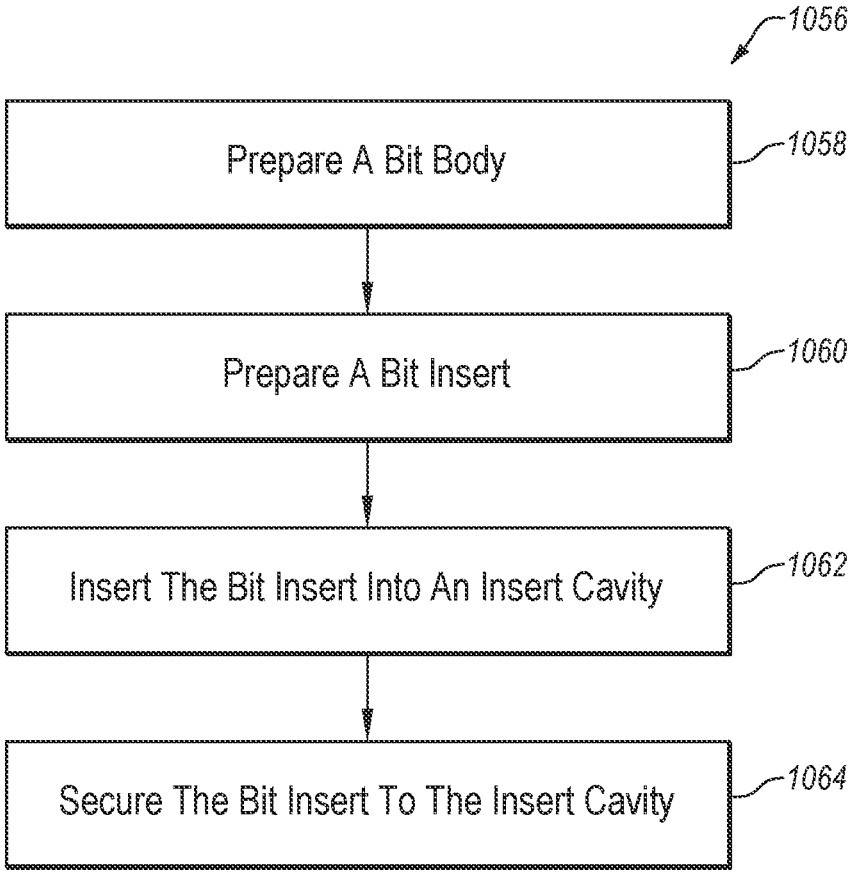
FIG. 10 is a flowchart of a method for assembling a bit, according to at least one embodiment of the present disclosure.

FIG. 10 is a flowchart of a method 1056 for manufacturing a bit, according to at least one embodiment of the present disclosure. The method 1056 includes preparing a bit body at 1058. The bit body defines an insert cavity. The insert cavity has a cavity profile. The method 1056 further includes preparing a bit insert at 1060. The bit insert has an insert profile. The insert profile is complementary to the cavity profile. The bit insert includes an insert cutting element. In some embodiments, preparing the bit insert may include preparing the bit insert in any manner. For example, preparing the bit insert may include additively manufacturing the bit insert. In some examples, preparing the bit insert may include casting the bit insert. In some examples, preparing the bit insert may include machining or subtractively manufacturing the bit insert.

The bit insert may be inserted into the insert cavity at 1062. In some embodiments, the bit insert may be secured to the insert cavity at 1064. In some embodiments, the bit insert may be secured to the insert cavity in any manner described herein. For example, bit insert may be secured to the insert cavity with a braze. In some examples, the bit insert may be secured to the insert cavity with a connection mechanism. In some embodiments, the bit insert may be secured to the insert cavity with both a braze and a connection mechanism. In some embodiments, securing the bit insert to the insert cavity may include threading the connection mechanism into the bit insert.

In accordance with at least one embodiment of the present disclosure, the bit may include a kit for a bit. A kit for a bit may include one or more parts or portions. Each part or portion may be interchangeable. For example, a bit may include a bit body. The bit body may include an insert cavity. The kit may include a plurality of bit inserts. Each bit insert may have an insert profile that is complementary to a cavity profile of the insert cavity. In this manner, the bit inserts may be interchangeable. This may allow a drilling operator to adjust the configuration of the bit by changing out the bit insert. In some embodiments, the kit may allow the drilling operator to repair cracked or damaged portions of the bit insert without replacing the bit.

In some embodiments, the method 1056 may include removing a bit insert. For example, the method 1056 may include removing a damaged insert. The damaged bit insert may be removed by increasing the temperature of the bit and the bit insert above the braze temperature such that the braze melts out and the bit insert may be removed. In some embodiments, the bit insert may be removed by unscrewing the relevant connection mechanism. In some embodiments, after the bit insert is removed, the method 1056 may include replacing the removed bit insert with a new bit insert, or the method 1056 may be repeated.

The embodiments of the bit insert have been primarily described with reference to wellbore drilling operations; the bit inserts described herein may be used in applications other than the drilling of a wellbore. In other embodiments, bit inserts according to the present disclosure may be used outside a wellbore or other downhole environment used for the exploration or production of natural resources. For instance, bit inserts of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A bit, comprising:
a bit body including:
a bore; and
an insert cavity hydraulically connected to the bore,
a plurality of blades connected to the bit body, wherein each blade of the plurality of blades includes a plurality of blade cutting elements;
a bit insert formed from a material that is less resilient than that of the bit body, the bit insert including:
an insert body, wherein the insert body comprises a plurality of hydraulic paths connected to a plurality of openings; and
an insert shaft connected to the insert body, wherein the insert body is inserted into the insert cavity, wherein the insert shaft extends to and is hydraulically connected with the bore, and wherein the bit insert is configured to be removable from the insert cavity; and
an insert cutting element connected to the bit insert in a cone region of the bit body.

2. The bit of claim 1, wherein the bit insert is rotationally fixed in the insert cavity.

3. The bit of claim 1, wherein the bit insert is located at a rotational axis of the bit body.

4. The bit of claim 1, wherein the bit insert includes an interlocking connection with the insert cavity.

5. The bit of claim 4, wherein the interlocking connection includes a threaded connection between the bit insert and the bit body.

6. The bit of claim 1, wherein the bit insert is brazed to the insert cavity.

7. The bit of claim 1, wherein the bit insert includes a nozzle hydraulically connected to the bore.

8. The bit of claim 1, wherein the insert body includes an insert shoulder, the insert shoulder engaging a seat within the insert cavity.

9. The bit of claim 1, wherein the bit insert defines the insert cavity, and wherein the insert cavity includes internal threads, and further comprising an attachment mechanism threaded into the internal threads of the insert cavity to secure the bit insert to the bit body.

10. The bit of claim 1, wherein the insert cutting element includes a plurality of cutting elements.

11. The bit of claim 1, wherein the insert cutting element is offset from a rotational axis of the bit body.

12. A kit for a bit, comprising:
a bit body, comprising:
an insert cavity;

a bore hydraulically connected to the insert cavity; and a plurality of blades extending from the bit body, each blade of the plurality of blades including a plurality of blade cutting elements; and a plurality of bit inserts, each bit insert of the plurality of bit inserts formed from a material that is less resilient than that of the bit body, the bit insert including;

an insert body;

a plurality of hydraulic paths connected to a plurality of openings; and an insert shaft connected to the insert body, wherein each of the plurality of bit inserts are configured to be inserted into and fixed to the insert cavity such that the insert shaft extends to and is hydraulically connected to the bore, each bit insert including an insert cutting element connected to the bit insert.

13. The kit of claim 12, wherein each bit insert of the plurality of bit inserts includes a different arrangement of the insert cutting element.

14. The kit of claim 12, wherein each bit insert of the plurality of bit inserts has a different exposure.

15. The kit of claim 12, wherein each bit insert has the same shape to fit in the insert cavity.

16. A method for manufacturing a bit, comprising:

preparing a bit body, the bit body defining an insert cavity hydraulically connected to a bore of the bit body, the insert cavity located in a cone region of the bit body, the insert cavity having a cavity profile;

preparing a bit insert, the bit insert formed from a material that is less resilient than that of the bit body, the bit insert including an insert profile, the insert profile complementary to the cavity profile, wherein the bit insert has an insert body and a plurality of hydraulic paths connected to a plurality of openings and an insert shaft connected to the insert body, wherein the bit insert further includes an insert cutting element;

inserting the bit insert into the insert cavity such that the insert shaft extends to the bore, and wherein each of the plurality of hydraulic paths are hydraulically connected with the bore; and securing the bit insert to the insert cavity.

17. The method of claim 16, wherein preparing the bit insert includes additively manufacturing the bit insert.

18. The method of claim 16, wherein securing the bit insert to the insert cavity includes brazing the bit insert to the insert cavity.

19. The method of claim 16, wherein securing the bit insert to the insert cavity includes threading a connection mechanism into the bit insert.

* * * * *